US011317223B2

(12) United States Patent
Zurbruegg et al.

(10) Patent No.: US 11,317,223 B2
(45) Date of Patent: Apr. 26, 2022

(54) HEARING DEVICE WITH ACTIVE FEEDBACK CONTROL

(71) Applicant: Sonova AG, Staefa (CH)

(72) Inventors: Thomas Zurbruegg, Frauenfeld (CH); Antonio Hoelzl, Zurich (CH); Paul Wagner, Meilen (CH); Fabian Hohl, Hombrechtikon (CH)

(73) Assignee: Sonova AG, Staefa (CH)

( * ) Notice: Subject to any disclaimer, the term of this patent is extended or adjusted under 35 U.S.C. 154(b) by 152 days.

(21) Appl. No.: 16/695,374

(22) Filed: Nov. 26, 2019

(65) Prior Publication Data

US 2020/0204929 A1 Jun. 25, 2020

(30) Foreign Application Priority Data

Dec. 19, 2018 (EP) ..... 18213956

(51) Int. Cl.
*H04R 25/00* (2006.01)
*G10K 11/178* (2006.01)

(52) U.S. Cl.
CPC ..... *H04R 25/453* (2013.01); *G10K 11/17825* (2018.01); *G10K 11/17875* (2018.01);
(Continued)

(58) Field of Classification Search
CPC .. H04R 25/505; H04R 25/356; H04R 25/502; H04R 25/453; H04R 25/407; H04R 25/65; H04R 25/652; H04R 25/658; H04R 25/604; H04R 25/60; H04R 25/456; H04R 2225/61; H04R 2225/43; H04R 2225/025; H04R 2430/03; H04R 1/1083; H04R 5/033; H04R 2460/01; H03H 21/0012;
(Continued)

(56) References Cited

U.S. PATENT DOCUMENTS 7,916,888 B2 3/2011 Sapiejewski
9,674,597 B1 6/2017 O Connell
(Continued)

FOREIGN PATENT DOCUMENTS

EP 2856771 B1 7/2016
WO 2012165976 A1 12/2012

OTHER PUBLICATIONS

European Patent Office, European Search Report for EP 18213956.8, dated Oct. 30, 2019, Munich Germany.

*Primary Examiner* — Ahmad F. Matar
*Assistant Examiner* — Sabrina Diaz
(74) *Attorney, Agent, or Firm* — ALG Intellectual Property, LLC

(57) ABSTRACT

The disclosure relates to a hearing device comprising a housing accommodating an acoustic transducer inside an inner volume of the housing, the acoustic transducer having an oscillator element configured to generate sound waves, the housing accommodating the acoustic transducer inside an inner volume of the housing. The hearing device further comprises a sound outlet configured to release sound waves from the inner volume into an ear canal. The hearing device may also comprise a microphone configured to be acoustically coupled to the ear canal, and an active feedback control circuit configured to provide an active feedback control signal to modify the sound waves generated by the acoustic transducer.

17 Claims, 4 Drawing Sheets

(52) U.S. Cl.
CPC ..... *H04R 25/604* (2013.01); *H04R 25/65* (2013.01); *G10K 2210/1081* (2013.01); *G10K 2210/3011* (2013.01); *H04R 2460/01* (2013.01)

(58) Field of Classification Search
CPC ..... F01N 1/065; G10K 2210/1081; G10K 2210/108; G10K 2210/3045; G10K 2210/112; G10K 2210/12822; G10K 2210/3011; G10K 11/1788; G10K 11/17825; G10K 11/17875
USPC ..... 381/317, 318, 322, 324, 328, 71.6, 71.7
See application file for complete search history.

(56) References Cited

U.S. PATENT DOCUMENTS

| | | | | |
|---|---|---|---|---|
| 2006/0083395 | A1 | 4/2006 | Allen | |
| 2013/0315411 | A1* | 11/2013 | Annunziata ..... | G10K 11/1785 381/71.6 |
| 2014/0044275 | A1* | 2/2014 | Goldstein ..... | H04R 1/1083 381/71.6 |
| 2014/0363040 | A1* | 12/2014 | Silvestri ..... | H04R 1/2888 381/380 |
| 2015/0382100 | A1 | 12/2015 | Azmi | |

* cited by examiner

HEARING DEVICE WITH ACTIVE FEEDBACK CONTROL

TECHNICAL FIELD

This disclosure generally relates to a hearing device, and more specifically to a hearing device comprising an active feedback control circuit connected to an ear canal microphone.

BACKGROUND

Hearing devices may be used to improve the hearing capability or communication capability of a user, for instance by compensating a hearing loss of a hearing-impaired user, in which case the hearing device is commonly referred to as a hearing instrument such as a hearing aid, or hearing prosthesis. A hearing device may also be used to produce a sound in a user's ear canal. Sound may be communicated by a wire or wirelessly to a hearing device, which may reproduce the sound in the user's ear canal. For example, earpieces such as earbuds, earphones or the like may be used to generate sound in a person's ear canal. Furthermore, hearing devices may be employed as hearing protection devices that suppress or at least substantially attenuate loud sounds and noises that could harm or even damage the user's sense of hearing. Hearing devices are often employed in conjunction with communication devices, such as smartphones, for instance when listening to sound data processed by the communication device and/or during a phone conversation operated by the communication device. More recently, communication devices have been integrated with hearing devices such that the hearing devices at least partially comprise the functionality of those communication devices.

Hearing devices can comprise a housing accommodating an acoustic transducer. The acoustic transducer typically comprises an oscillator element driven by an electromagnetic circuit and configured to produce sound waves. For instance, the oscillator element can be a diaphragm or any other vibrational body and/or substance configured to radiate sound waves by moving back and forth in a surrounding propagation medium, such as air. Different types of hearing devices can be distinguished by the position at which the housing is intended to be worn relative to an ear canal of the user. Hearing devices which are configured such that the housing enclosing the transducer can be at least partially inserted into the ear canal can include, for instance, earbuds, earphones, and hearing instruments such as receiver-in-the-canal (RIC) hearing aids, in-the-ear (ITE) hearing aids, invisible-in-the-canal (IIC) hearing aids, and completely-in-the-canal (CIC) hearing aids. The housing can be an earpiece adapted for an insertion and/or a partial insertion into the ear canal. Some hearing devices comprise a housing having a standardized shape intended to fit into a variety of ear canals of different users. Other hearing devices comprise a housing having a customized shape adapted to an ear canal of an individual user. The customized housing can be a shell, in particular a shell of a hearing instrument. The shell can be formed, for instance, from an ear mould.

Active feedback control (AFC) has been implemented in hearing devices to attenuate unwanted components of sound waves, in particular noise, propagating into the ear canal. Typically, such a hearing device comprises an ear canal microphone configured to be acoustically coupled to the ear canal and an active feedback control circuit connected to the ear canal microphone. The active feedback control circuit can thus provide an active feedback control signal to modify the sound waves generated by the acoustic transducer. For instance, an active noise control (ANC) and/or active noise reduction (ANR) can thus be provided by adding additional sound waves specifically adapted to cancel or at least reduce the unwanted sound. Some examples of an active feedback control circuit configured to provide for an active noise reduction in a hearing device are disclosed in publication U.S. Pat. Nos. 4,985,925, 8,682,001 B2, 9,792,893 B1, US 2018/0286373 A1, and US 2018/0197527 A1.

Accordingly, a need exists for an improved hearing device that provides additional benefits.

BRIEF SUMMARY

A desired quality of the sound delivered by current hearing devices including active feedback control, however, is often restricted by an instable performance of the feedback control loop. The instabilities can not only limit an intended amount of noise reduction but can also produce additional sound distortions such as clicking, whistling or cracking noises. Those sound distortions can be even more disturbing when they are generated directly inside the ear canal. Feedback control instabilities can be particularly noticeable at a frequency range above 1 kHz. The instabilities can be reduced to a certain extent by an adequate processing and/or filtering of the feedback control signal as proposed in US 2018/0286373 A1. Moreover, it has been proposed in U.S. Pat. No. 9,792,893 B1 to provide a nozzle with a rather low acoustic impedance at certain frequency ranges serving as a sound outlet at the housing. Those measures, however, can only reduce the feedback instabilities to an unsatisfactory extent. One reason for this is that the feedback performance may be optimized by the sound processing and/or filtering for a certain ear canal geometry defining a characteristic input impedance, in particular load impedance, of the ear canal when the hearing device is at least partially inserted. But the response behavior of the hearing device rather strongly depends on the input impedance and therefore varies with differing ear canal geometries. This makes it difficult to avoid the feedback instabilities in a range of ear canals of different users by the measures proposed in prior art. In addition, those performance variations of the hearing device with a specifically designed feedback loop can not only occur when applied in different ears but also during differing placements of the hearing device within the same ear canal, for instance when the hearing device is removed and inserted again into the ear canal.

It is an object of the present disclosure to avoid at least one of the above mentioned disadvantages and to provide for a reliable and/or stable active feedback control in a hearing device, in particular within a frequency range particularly relevant for a desired performance of sound delivery. It is another object to allow an active feedback control in a hearing device yielding a rather uniform sound delivery of the hearing device when inserted in different ear canals and/or when repeatedly positioned inside an ear canal, at least at a particular frequency range. It is yet another object to provide a hearing device including active feedback control in which sound distortions caused by the feedback loop can be reduced or avoided. It is a further object to equip the hearing device with acoustical constituent parts which provide a physical impact on the sound waves in a way in which a desired performance of sound delivery can be ensured, at least within a desired frequency range, in particular such that an additional signal processing and/or filtering can be provided in the feedback loop in a more reliable and/or stable way.

Accordingly, the disclosure proposes a hearing device comprising a housing configured to be at least partially inserted into an ear canal and an acoustic transducer having an oscillator element configured to generate sound waves. The housing accommodates the acoustic transducer inside an inner volume of the housing. The hearing device further comprises a sound outlet provided at the housing and configured to release sound waves from the inner volume into the ear canal. The hearing device further comprises a microphone configured to be acoustically coupled to the ear canal. The hearing device further comprises an active feedback control circuit configured to provide an active feedback control signal to modify the sound waves generated by the acoustic transducer. The active feedback control circuit is connected to the microphone. The acoustic transducer and the housing are configured such that the output impedance of the hearing device measured at the sound outlet has a value of at most $3.5 \cdot 10^7$ kg/(m$^4$·sec) within a frequency bandwidth of at least 50 Hz comprised in a frequency range between 1000 Hz and 2000 Hz.

Independently, in particular independent from the hearing device mentioned above, the disclosure also proposes a hearing device comprising a housing configured to be at least partially inserted into an ear canal and an acoustic transducer having an oscillator element configured to generate sound waves. The housing accommodates the acoustic transducer inside an inner volume of the housing. The hearing device further comprises a sound outlet provided at the housing and configured to release sound waves (or enable propagation of sound waves) from the inner volume into the ear canal. The hearing device further comprises a resonant member configured to resonate with sound waves at a resonance frequency. The resonant member is acoustically coupled with said inner volume.

In some implementations, at least one of the additional features of a hearing device further detailed in the subsequent description can be applied in each of the two above described hearing devices independent from one another. In some other implementations, features of the two above described hearing devices can also be combined, in particular in combination with at least one of the additional features according to the subsequent description.

The present disclosure thus employs acoustical properties of the inner volume of the housing and/or the acoustic transducer provided inside. In some implementations, customizing those acoustical properties can be applied to yield a lower dependence on ear specific properties. This can allow a more reliable and/or stable sound delivery inside an ear canal, in particular when an active feedback control is provided in the hearing device. According to an aspect of the present disclosure, the acoustic output impedance of the hearing device measurable at the sound outlet can be selected such that it has a significantly lower value as compared to an acoustic input impedance of an ordinary ear canal when the hearing device is at least partially inserted into the ear canal, at least within a frequency range in which the hearing device can be prone to instable behavior. The input impedance may be also referred to as a load impedance. The input impedance representative for an ordinary ear canal can be defined, for instance, as an averaged input impedance and/or a range of input impedances representative for a large number of ear canals of different users. Lowering the output impedance of the hearing device in such a manner may result in less favorable other characteristics of the sound waves released from the inner volume into the ear canal through the sound outlet, for instance a decreased sound pressure and/or volume flow. In the context of the present disclosure, however, such a trade-off can be usefully exploited. For instance, a certain degree of independence of the hearing device performance from an ear canal arbitrarily picked out from a rather large variety of ear canals can be achieved, in particular when providing an active feedback control in a hearing device. The acoustic output impedance can thus be provided at a value relative to which variations of the acoustic input impedance occurring in differing ear canals can be negligible. This can be exploited to provide an acoustic behavior of the hearing device that is rather unsusceptible to changing ear canal geometries. A ratio of the output impedance and the input impedance can thus be kept rather low such that the acoustic behavior hardly depends on varying values of the input impedance. In this way, input impedance variations of different ear canals can be made less significant for the actual device performance.

According to another aspect of the present disclosure, the adaption of acoustical properties of the hearing device can be provided in a frequency selective manner, in particular such that the acoustical properties can be customized with respect to a lower dependence on ear specific properties. The frequency selective adaption can be customized to a frequency range in which the hearing device can exhibit an instable behavior, in particular when providing an active feedback control in a hearing device. The frequency selective adaption can be targeted to provide an output impedance, in particular an upper threshold value of the output impedance, at least within the desired frequency range. The frequency selective adaption can be provided by the resonant member, in particular by a selected resonance frequency of the resonant member. In some implementations, the frequency range can comprise frequencies of 1000 Hz and above, in particular between 1000 Hz and 2000 Hz, more particularly between 1000 Hz and 1500 Hz. In some implementations, the frequency range can comprise frequencies of 100 Hz and below. It has been found that those frequency ranges can be particularly decisive when an active feedback control is provided in the hearing device.

The inner volume inside the housing can provide an acoustic pathway for sound waves produced from the oscillator element. In some implementations, the housing comprises a first housing portion enclosing a first volume portion of the inner volume in front of the oscillator element. The housing can comprise a second housing portion enclosing a second volume portion of the inner volume behind the oscillator element. The first volume portion and the second volume portion can be acoustically coupled by the oscillator element. In this way, acoustical properties of the hearing device can be influenced by an appropriate selection of the first volume portion and the second volume portion and/or an appropriate positioning of the oscillator element between the first volume portion and the second volume portion. In some implementations, the oscillator element is positioned inside the inner volume such that the first volume portion is at least two times smaller than the second volume portion. This can contribute to a rather low output impedance, in particular below a threshold value of an average input impedance. In some implementations, the first volume portion has a value of at most $25 \cdot 10^{-8}$ m$^3$. In some implementations, the second volume portion has a value of at least $50 \cdot 10^{-8}$ m$^3$. It has been found that choosing such a value of the first volume and/or the second volume can be essential to provide an output impedance of $3.5 \cdot 10^7$ kg/(m$^4$·sec), in particular $2 \cdot 10^7$ kg/(m$^4$·sec) and/or below.

A virtual partition separating the first volume portion and the second volume portion can be defined by the oscillator element, in particular at a radial region of the inner volume in which the oscillator element extends. At a radial region of the inner volume extending outside the oscillator element, the virtual partition can further comprise a virtual plane intersecting a front end of the oscillator element. In particular, the front end can be provided by an outer edge of the oscillator element. The outer edge can extend around an outer circumference of the oscillator element. Thus, the first volume portion can be defined as a volume portion of the inner volume in front of the oscillator element, in particular the virtual partition. The second volume portion can be defined as a volume portion of the inner volume behind the oscillator element, in particular the virtual partition. In some implementations, the virtual partition comprises a partition wall between the first volume portion and the second volume portion. The partition wall can comprise the oscillator element.

In some implementations, the hearing device comprises an acoustic port separate from the oscillator element. The acoustic port can be an inner acoustic port acoustically coupling the first volume portion with the second volume portion. The inner acoustic port can be provided in the inner volume of the housing, in particular at the virtual partition. The acoustic port can be an outer acoustic port acoustically coupling the inner volume to an ambient environment outside the inner volume, in particular the first volume portion to the ambient environment and/or the second volume portion to the ambient environment. In some implementations, the hearing device comprises the outer acoustic port as a first acoustic port and further comprises a second acoustic port. The second acoustic port can be an inner acoustic port or an additional outer acoustic port. In particular, the first acoustic port can be an outer acoustic port acoustically coupling the first chamber to the ambient environment and the second acoustic port can be an outer acoustic port acoustically coupling the second chamber to the ambient environment. In some implementations, the hearing device further comprises a third acoustic port. The third acoustic port can be an inner acoustic port acoustically coupling the first volume portion with the second volume portion. By acoustically coupling the first volume portion and the second volume portion with each other and by acoustically coupling each of the first volume portion and the second volume portion to the ambient environment, a rather homogeneous coupling of the inner volume inside the housing to the ambient environment can be realized. This can be exploited, on the one hand, to configure the hearing device such that the released sound waves match desired characteristics, in particular with respect to an output impedance of the hearing device. On the other hand, the adjustability of the released sound to varying hearing situations can be further improved.

In some implementations, the first acoustic port is provided in a housing portion enclosing the first volume portion. In some implementations, the second acoustic port is provided in a housing portion enclosing the second volume portion. In some implementations, the second acoustic port is provided at the virtual partition separating the first volume portion and the second volume portion. In some implementations, the third acoustic port is provided at the virtual partition separating the first volume portion and the second volume portion. In some implementations, the sound outlet is provided at a housing portion enclosing the second volume portion, in particular at a rear wall and/or a side wall of the housing. In some implementations, the sound outlet is provided at a housing portion enclosing the first volume portion, in particular at a rear wall and/or a side wall of the housing. In some implementations, the acoustic port comprises an aperture through which the acoustic coupling is provided. In particular, at least one of the first acoustic port, second acoustic port, and third acoustic port comprises such an aperture. The acoustic port can comprise a tubular member in which the aperture is provided. The aperture can define an acoustic mass of the acoustic port. In particular, a length and/or cross section of the tubular member can be selected such that a desired acoustic mass is provided at the acoustic port.

In some implementations, the hearing device comprises an acoustic resistance. The acoustic resistance can comprise a first terminal and a second terminal. The acoustic resistance can be configured to attenuate sound waves propagating between the first terminal and the second terminal, in particular a sound pressure of the sound waves. The acoustic resistance can comprise a sound resistive body between the first terminal and the second terminal. The sound resistive body can comprise, for instance, a grid structure such as a wire mesh and/or a damping material such as a cloth. In some implementations, the first terminal and the second terminal of the acoustic resistance are positioned such that they provide an acoustical coupling between two volume portions corresponding to the volume portions acoustically coupled by the acoustic port, in particular at least one of the first acoustic port, the second acoustic port and the third acoustic port. The volume portions acoustically coupled by the first acoustic port can be the first volume portion and the ambient environment. The volume portions acoustically coupled by the second acoustic port can be the second volume portion and the first volume portion. The volume portions acoustically coupled by the second acoustic port can be the second volume portion and the ambient environment. The volume portions acoustically coupled by a third acoustic port can be the second volume portion and the first volume portion. The acoustic resistance can provide a customization of acoustic properties at the acoustic pathway inside the housing, in particular with respect to a desired frequency response and/or output impedance.

In some implementations, the acoustic resistance is provided in a housing portion enclosing the first volume portion. In some implementations, the acoustic resistance is provided in a housing portion enclosing the second volume portion. In some implementations, the acoustic resistance is provided in the inner volume of the housing, in particular between the first volume portion and the second volume portion. In some implementations, the acoustic resistance is provided in series with the acoustic port, in particular at least one of the first acoustic port, second acoustic port, and third acoustic port. The acoustic resistance can then be provided at the position of the acoustic port. In this way, acoustic properties of the acoustic port can be adjusted. In some implementations, the acoustic resistance is provided in parallel to the acoustic port, in particular at least one of the first acoustic port, second acoustic port, and third acoustic port. The acoustic resistance can then be provided in the housing portion and/or at the virtual partition comprising the acoustic port at a distance to the acoustic port. In particular, the acoustic resistance can be provided in the first housing portion and/or in the second housing portion at a distance to the outer acoustic port provided in the respective housing portion. Thus, the acoustic resistance can be provided in parallel to the outer acoustic port acoustically coupling the inner volume with the ambient environment. The acoustic resistance can also be provided at the virtual partition at a distance to the inner acoustic port. Thus, the acoustic resistance can be provided in parallel to the inner acoustic port acoustically coupling the first volume portion and the second volume portion. In this way, the acoustic resistance can be employed to specify acoustic properties of the acoustic pathway inside the housing at a position remote from the acoustic port, in particular to adjust the output impedance in a desired way.

In some implementations, the hearing device comprises a first acoustic resistance and a second acoustic resistance. The volume portions acoustically coupled by the first acoustic resistance can comprise the first volume portion and the ambient environment. The volume portions acoustically coupled by the second acoustic resistance can comprise the second volume portion and the ambient environment. Alternatively or additionally, the volume portions acoustically coupled by the second acoustic resistance can comprise the second volume portion and the first volume portion. In some implementations, the hearing device comprises a third acoustic resistance. The volume portions acoustically coupled by the third acoustic resistance can comprise the second volume portion and the first volume portion. In this way, the acoustic pathway inside the housing can be configured at various positions with desired acoustic properties to yield a desired output impedance of the hearing device.

In some implementations, the hearing device comprises a first acoustic resistance and a second acoustic resistance. The first acoustic resistance can be provided in parallel to the acoustic port, in particular the first acoustic port or the second acoustic port or the third acoustic port, and the second acoustic resistance can be provided in series with the acoustic port. In some implementations, the hearing device further comprises a third acoustic resistance and a fourth acoustic resistance. The third acoustic resistance can be provided in parallel to a different acoustic port than the first acoustic resistance and the fourth acoustic resistance can be provided in series with a different acoustic port than the second acoustic resistance. In some implementations, the hearing device further comprises a fifth acoustic resistance and a sixth acoustic resistance. The fifth acoustic resistance can be provided in parallel to a different acoustic port than the first acoustic resistance and the third acoustic resistance and the sixth acoustic resistance can be provided in series with a different acoustic port than the second acoustic resistance and the fourth acoustic resistance. The advantages of providing the acoustic resistance in a parallel configuration and in a series configuration relative to the acoustic port can thus be combined providing a more refined way of configuring acoustic properties at the acoustic pathway to provide an advantageous value of the output impedance.

In some implementations, the acoustic transducer comprises an oscillation drive. The oscillator element can be operatively connected to the oscillation drive. The oscillation drive can be configured to generate vibrations of the oscillator element, in particular such that the oscillator element produces sound waves emanating from the oscillator element. The oscillator element can comprise a diaphragm and/or a membrane. The oscillation drive can comprise a coil assembly for generating a magnetic field driving the oscillator element. A suspension member can be connected to the oscillator element. The suspension member can be configured to support the oscillator element inside the housing, in particular such that the oscillator element can be retained relative to the housing during oscillations of the oscillator element. The suspension member can mechanically couple the oscillator element and the housing. In particular, an inner surface of the housing surrounding the inner volume can be mechanically coupled to the oscillation member. The acoustic transducer can comprise the suspension member. In particular, the suspension member can be mechanically coupled to the acoustic transducer and the acoustic transducer can be mechanically coupled to the housing. The suspension member can be flexible. A flexibility of the suspension member can be defined by a mechanical compliance of the suspension member. A mechanical compliance of other constituent parts relevant for the mechanical coupling between the oscillator element and the housing, in particular the oscillation drive, may be computationally added to the value of the mechanical compliance of the suspension member. The mechanical compliance of other constituent parts relevant for the mechanical coupling may also be negligible with respect to the mechanical compliance of the suspension member.

The coil assembly can comprise a magnet and a voice coil. The voice coil can be provided inside a magnetic field of the magnet. A variable magnetic interaction between the magnet and the voice coil can thus be provided by a changing electric current through the voice coil. The variable magnetic interaction can induce a periodic movement of the voice coil. The oscillator element can be mechanically coupled to the voice coil. Thus the periodic movement of the voice coil can be translated into a vibrational movement of the oscillator element in order to produce sound waves emanating from the oscillator element. In some implementations, the acoustic transducer can be a speaker driver and/or a driver. In some implementations, the acoustic transducer can be a driver, in particular a dynamic driver. In some implementations, the acoustic transducer can be a balanced armature transducer.

In some implementations, an active area of the acoustic transducer can be defined as a virtual plane delimited by a front end of the oscillator element. In particular, the active area can have a boundary at the front end, in particular at an outer edge of the oscillator element. The oscillator element can comprise a conical portion. Sound waves can be emanated from an inner surface of the conical portion. The active area can be a virtual base line of the conical portion. The active area can be oriented so that it faces in a direction in which the oscillator element is configured to oscillate, in particular a direction in which sound waves propagate during oscillation of the oscillator element. In some implementations, the active area has a value of at least $5 \cdot 10^{-5}$ $m^2$. This can allow to keep the output impedance of the hearing device rather low. In some implementations, the active area has a value of at most $15 \cdot 10^{-5}$ $m^2$, in particular a value in a range between $5 \cdot 10^{-5}$ $m^2$ and $15 \cdot 10^{-5}$ $m^2$. The acoustic transducer can thus be adequately dimensioned to be provided in the inner volume in some implementations of a housing geometry customized to fit into an average ear canal with a desired behaviour of the output impedance. In some implementations, the acoustic transducer has a diameter of at least $9 \cdot 10^{-3}$ m at the front end. The acoustic transducer can have a diameter of at most $14 \cdot 10^{-3}$ m at the front end. The diameter can be a nominal diameter, for instance as defined by a manufacturer of the acoustic transducer. In some implementations, the oscillator element has mass of at most $30 \cdot 10^{-6}$ kg. In some implementations, the suspension member has a mechanical compliance of at least $12 \cdot 10^{-3}$ $sec^2/kg$, in particular at least $20 \cdot 10^{-3}$ $sec^2/kg$. These measures can further contribute to the desired behaviour of the output impedance.

In some implementations, the hearing device comprises a resonant member configured to resonate with sound waves at a resonance frequency. The resonant member can be acoustically coupled with the inner volume of the housing. In this way, acoustical properties of the acoustic pathway in the inner volume can be adjusted in a frequency dependent manner, in particular such that a desired behavior of the output impedance can be provided at a desired frequency range. In some implementations, the resonant member is configured to resonate with sound waves at a resonance frequency. The resonance frequency can be comprised in a frequency range between 800 Hz and 4000 Hz, in particular between 1000 Hz and 2000 Hz, more particularly between 1000 Hz and 1500 Hz. In some implementations, the resonant member is configured to resonate with sound waves at a resonance frequency comprised in a frequency range of 100 Hz and below. In this way, the output impedance can be decreased in the respective frequency range.

In some implementations, the resonant member is acoustically coupled with the first volume portion. The hearing device can comprise an acoustic port acoustically coupling the resonant member with the first volume portion. The acoustic port for the resonant member can be separate from an inner acoustic port acoustically coupling the first volume portion with the second volume portion and/or an outer acoustic port acoustically coupling the inner volume with the ambient environment. The acoustical coupling of the resonant member with the first volume portion can allow an adjustment of the output impedance at a specific frequency range in a particularly effective way. The acoustic port can comprise an aperture through which the acoustic coupling is provided. The acoustic port can comprise a tubular member in which the aperture is provided. The tubular member can acoustically connect the first volume portion with the resonant member. A length and/or cross section of the tubular member can be selected such that a desired acoustic mass is provided at the acoustic port. In some implementations, the resonant member is acoustically coupled with the second volume portion. The hearing device can comprise an acoustic port acoustically coupling the resonant member with the second volume portion. In some implementations, the resonant member is a first resonant member acoustically coupled with the first volume portion, wherein the hearing device comprises a second resonant member acoustically coupled with the second volume portion.

In some implementations, the resonant member is provided in front of the oscillator element. In particular, the resonant member can be provided in front of the virtual partition separating the first volume portion and the second volume portion. The acoustical coupling of the resonant member with the first volume portion can also be provided in front of the oscillator element, in particular in front of the virtual partition. An acoustic port acoustically coupling the resonant member with the first volume portion can be provided in front of the virtual partition. In this manner, the resonant member may be positioned rather close to the first volume portion. The resonant member can be enclosed by the first housing portion enclosing the first volume portion of the inner volume. This can allow a rather compact accommodation of the resonant member inside the housing. The resonant member can be provided externally from the first housing portion. Such a configuration may be applied, for instance, when desired acoustic properties of the first volume portion enclosed by the first hosing portion can be compromised by an internal arrangement of the resonant member. In particular, the resonant member can be provided between the first housing portion and the second housing portion.

In some implementations, the resonant member is provided behind the oscillator element. In particular, the resonant member can be provided behind the virtual partition separating the first volume portion and the second volume portion. The acoustical coupling of the resonant member with the first volume portion can pass through the virtual partition separating the first volume portion and the second volume portion. An acoustic port acoustically coupling the resonant member with the first volume portion can thus be provided between the first volume portion and a region behind the virtual partition. The acoustic port can comprise a tubular member extending between the first volume portion and the resonant member. The acoustical coupling of the resonant member with the first volume portion can bypass the oscillator element between the first volume portion and the resonant member. In this manner, the resonant member may be positioned at a distance from the first volume portion. This may be exploited to adapt a front portion of the hearing device located in front of the virtual partition in a desired way without being compromised by the resonant member, in particular such that the front portion comprises a shape in which it can be favourably positioned inside an ear canal, and to provide at the same time desired acoustic properties of the first volume portion enclosed by the first hosing portion, in particular with respect to a desired behaviour of the output impedance. The resonant member can be enclosed by the second housing portion enclosing the second volume portion of the inner volume. This can allow a rather compact accommodation of the resonant member inside the housing. The resonant member can be provided externally from the second housing portion. Such a configuration may be applied, for instance, when desired acoustic properties of the second volume portion enclosed by the first hosing portion can be compromised by an internal arrangement of the resonant member. In particular, the resonant member can be provided between the first housing portion and the second housing portion.

In some implementations, the resonant member is a first resonant member, wherein the hearing device comprises a second resonant member configured to resonate with sound waves at a resonance frequency. At least one of the first resonant member and the second resonant member can be acoustically coupled with the first volume portion. The hearing device can comprise an acoustic port for the first resonant member acoustically coupling the first resonant member with the first volume portion. The hearing device can comprise an acoustic port for the second resonant member acoustically coupling the second resonant member with the first volume portion. The acoustic port for the first resonant member and the acoustic port for the second resonant member can be at least partially separate from one another. The second resonant member can be configured to resonate with sound waves at a different resonance frequency than the first resonant member. Thus, a frequency dependent adjustment of the output impedance can be tuned in a more refined way. The second resonant member can be configured to resonate with sound waves at the same resonance frequency than the first resonant member. Thus, an increased impact on the output impedance at a specific frequency range can be achieved. In some implementations, the first resonant member and the second resonant member are each configured to resonate with sound waves at a resonance frequency comprised in a frequency range between 800 Hz and 4000 Hz, in particular between 1000 Hz and 2000 Hz, more particularly between 1000 Hz and 1500 Hz. In some implementations, the first resonant member and the second resonant member are each configured to resonate with sound waves at a resonance frequency comprised in a frequency range of 100 Hz and below. This can allow a more refined adjustment of the output impedance within the respective frequency range. In some implementations, the first resonant member is configured to resonate with sound waves at a resonance frequency comprised in a frequency range between 800 Hz and 4000 Hz, in particular between 1000 Hz and 2000 Hz, more particularly between 1000 Hz and 1500 Hz, and the second resonant member is configured to resonate with sound waves at a resonance frequency comprised in a frequency range of 100 Hz and below. This can allow an adjustment of the output impedance within both frequency ranges.

In some implementations, the hearing device comprises a third resonant member configured to resonate with sound waves at a resonance frequency. The third resonant member can also be acoustically coupled with the inner volume. In particular, the third resonant member can be acoustically coupled with the first volume portion. The hearing device can comprise an acoustic port for the third resonant member acoustically coupling the third resonant member with the first volume portion. The third resonant member can be configured to resonate with sound waves at a different resonance frequency than at least one of the first resonant member and the second resonant member. The third resonant member can be configured to resonate with sound waves at the same resonance frequency as at least one of the first resonant member and the second resonant member. In some implementations, the hearing device further comprises a number of additional resonant members. At least one additional resonant member can be configured to resonate with sound waves at a resonance frequency different from the resonance frequency of at least one other resonant member, in particular of all other resonant members. By providing a sufficient large number of additional resonance members in such a manner, the frequency selective adjustment of the output impedance can be implemented at an arbitrary accuracy. At least one additional resonant member can be configured to resonate with sound waves at the same resonance frequency as compared to at least one other resonant member. In this way, the output impedance at a specific frequency range can be adjusted at a desired degree. At least one additional resonant member can be acoustically coupled with the inner volume. In particular, at least one additional resonant member can be acoustically coupled with the first volume portion. The hearing device can comprise an acoustic port for each additional resonant member acoustically coupling the additional resonant member with the first volume portion. In some implementations, the resonant members can be configured to resonate with sound waves at a resonance frequency comprised in a frequency range between 800 Hz and 4000 Hz, in particular between 1000 Hz and 2000 Hz, more particularly between 1000 Hz and 1500 Hz, and/or in a frequency range of 100 Hz and below.

In some implementations, the resonant member encloses a cavity filled with a medium. The resonant member can comprise a vessel enclosing the cavity. The resonant member can further comprise an opening at which the medium is configured to resonate with sound waves. The opening can be provided with an oscillating member, in particular a membrane, such that the medium is configured to resonate with the sound waves through the oscillating member.

The opening can be free such that the medium is configured to resonate directly with the sound waves. In particular, the resonant member can be a Helmholtz resonator. The acoustic port acoustically coupling the resonant member with the first volume portion can lead to the opening of the resonant member. The medium can be a sound propagation medium, for instance air and/or water. At least a part of the medium inside the cavity can form an acoustic compliance of the resonant member. At least a part of the medium at the opening can form an acoustic inertance of the resonant member. A vibration of the medium inside the resonant member, in particular at a resonance frequency of the resonant member, can thus be caused by an interaction of the compliance and the inertance inside the resonance member, in analogy to a spring-mass system. The resonance frequency of the resonant member can be set by an appropriate selection of the cavity, in particular a cavity size and/or geometry, the opening, in particular an opening size and/or geometry, and the medium inside the cavity. An appropriate variation of these parameters can thus allow to provide a different resonance frequency for different resonance members, in particular for at least two of said first resonant member, second resonant member, third resonant member and additional resonant member.

In some implementations, the resonant member, in particular the vessel of the resonant member, comprises a wider portion leading to a narrower portion comprising the opening. In particular, the narrower portion can be formed by a throat and/or tapering and/or spout and/or tubular member. For instance, the resonant member can exhibit a bottle-like shape including a bottle base corresponding to the wider portion and a bottleneck corresponding to the narrower portion.

In some implementations, the acoustic transducer and the housing are configured such that the output impedance of the hearing device measured at the sound outlet has a value of at most $3.5 \cdot 10^7$ kg/(m$^4$·sec), in particular of at most $2 \cdot 10^7$ kg/(m$^4$·sec), within a frequency bandwidth of at least 50 Hz comprised in a frequency range between 1000 Hz and 2000 Hz, in particular between 1000 Hz and 1500 Hz. In some implementations, the output impedance has a value of at most $3.5 \cdot 10^7$ kg/(m$^4$·sec), in particular of at most $2 \cdot 10^7$ kg/(m$^4$·sec), within a frequency bandwidth of at least 100 Hz comprised in this frequency range. In some implementations, the output impedance has a value of at most $3.5 \cdot 10^7$ kg/(m$^4$·sec), in particular of at most $2 \cdot 10^7$ kg/(m$^4$·sec), within a frequency bandwidth of at least 200 Hz comprised in this frequency range. In some implementations, increasing the frequency bandwidth in which the output impedance of at most $3.5 \cdot 10^7$ kg/(m$^4$·sec) is provided within said frequency range can further improve the acoustic behavior of the device, in particular with respect to a stabilization of the feedback loop. In some implementations, the output impedance has a value of at most $3.5 \cdot 10^7$ kg/(m$^4$·sec), in particular of at most $2 \cdot 10^7$ kg/(m$^4$·sec), over this frequency range. An output impedance of at most $2 \cdot 10^7$ kg/(m$^4$·sec) within this frequency range can be preferred to further improve the acoustic behavior of the device, in particular to further reduce instabilities of the feedback loop.

In some implementations, the acoustic transducer and the housing are configured such that the output impedance of the hearing device measured at the sound outlet has a value of at most $10^8$ kg/(m$^4$·sec) within a frequency bandwidth of at least 50 Hz comprised in a frequency range of 100 Hz and below. In some implementations, the output impedance has a value of at most $10^8$ kg/(m$^4$·sec) within a frequency bandwidth of at least 100 Hz comprised in this frequency range. In some implementations, the output impedance has a value of at most $10^8$/(m$^4$·sec) within a frequency bandwidth of at least 200 Hz comprised in this frequency range. In some implementations, the output impedance has a value of at most $10^8$ kg/(m$^4$·sec) over this frequency range. In some implementations, the acoustic transducer and the housing are configured such that the above specified values of the output impedance within the respective frequency bandwidth in the frequency range between 1000 Hz and 2000 Hz, in particular between 1000 Hz and 1500 Hz, and in the frequency range of 100 Hz and below are combined. The output impedance can be measurable at the sound outlet by feeding sound waves into the inner volume through the sound outlet and detecting the sound waves at the sound outlet, in particular detecting the sound waves returning from the inner volume at the sound outlet. The output impedance can also be measurable at the sound outlet by producing an acoustic flow through the sound outlet into the inner volume and detecting an acoustic pressure at the sound outlet. In particular, the output impedance can refer to an impedance value measured at the sound outlet when no sound waves are generated by acoustic transducer.

In some implementations, the acoustic transducer and the housing are configured such that a microphone position acoustic impedance measured at an input of the microphone has a value of at most $3.5 \cdot 10^7$ kg/(m$^4$·sec), in particular at most $2 \cdot 10^7$ kg/(m$^4$·sec), within a frequency bandwidth of at least 50 Hz, in particular 100 Hz and more particularly 200 Hz, comprised in a frequency range between 1000 Hz and 2000 Hz, in particular between 1000 Hz and 1500 Hz. In some implementations, the acoustic transducer and the housing are configured such that a microphone position acoustic impedance measured at an input of the microphone has a value of at most $3.5 \cdot 10^7$ kg/(m$^4$·sec), in particular of at most $2 \cdot 10^7$ kg/(m$^4$·sec), over a frequency range between 1000 Hz and 2000 Hz, in particular between 1000 Hz and 1500 Hz. In some implementations, the acoustic transducer and the housing are configured such that a microphone position acoustic impedance measured at an input of the microphone has a value of at most $10^8$ kg/(m$^4$·sec) within a frequency bandwidth of at least 50 Hz, in particular 100 Hz and more particularly 200 Hz, comprised in a frequency range of 100 Hz and below. In some implementations, the acoustic transducer and the housing are configured such that the above specified values of the microphone position acoustic impedance measured at an input of the microphone has a value of at most $10^8$ kg/(m$^4$·sec) over a frequency range of 100 Hz and below. In some implementations, the acoustic transducer and the housing are configured such that the microphone position acoustic impedance within the respective frequency bandwidth in the frequency range between 1000 Hz and 2000 Hz, in particular between 1000 Hz and 1500 Hz, and in the frequency range of 100 Hz and below are combined.

By selecting the acoustic impedance at the position of the input of the microphone in such a way, instabilities arising from the feedback loop can be at least reduced. In particular, the microphone position acoustic impedance can thus be selected to be low enough such that variations of the acoustic input impedance measured in different ear canals can be neglected relative to the microphone position acoustic impedance. A ratio of the microphone position acoustic impedance and the acoustic input impedance can thus be kept rather low such that the acoustic behavior hardly depends on varying values of the input impedance. In this way, a rather independent acoustic behavior of the hearing device with respect to an actual ear canal geometry can be provided. The microphone position acoustic impedance can be measurable at the input of the microphone by producing an acoustic flow at the position of the input of the microphone into the inner volume, in particular toward the oscillator element, and detecting an acoustic pressure at the position of the input of the microphone. The microphone position acoustic impedance can also be measurable at the input of the microphone by feeding sound waves from the position of the input of the microphone into the inner volume, in particular toward the oscillator element, and detecting the sound waves at the position of the input of the microphone, in particular the sound waves returning from the inner volume from a side at which the oscillator element is provided.

In some implementations, the microphone is provided in the inner volume. In particular, the microphone can be provided in the first volume portion. In some implementations, the microphone is provided outside the inner volume, in particular at a region outside the housing positioned at an inner ear canal region when the housing is at least partially inserted in the ear canal. The microphone can be an ear canal microphone. The microphone can be configured to provide a feedback microphone signal to the active feedback control circuit. The active feedback control circuit can be configured to modify the sound waves generated by the acoustic transducer depending on the feedback microphone signal, in particular after a processing of the feedback microphone signal. The processing of the feedback microphone signal can comprise at least one of a filtering, adding, subtracting, and amplifying of the feedback microphone signal. In some implementations, a feedback loop comprises the microphone and the active feedback control circuit. The feedback control circuit can be connected to the acoustic transducer. In some implementations, the feedback loop is configured to provide an active noise control (ANC) or active noise reduction (ANR) of the sound waves generated by the acoustic transducer. In some implementations, a feed forward loop is connected to the acoustic transducer, in particular in addition to the feedback loop.

BRIEF DESCRIPTION OF THE DRAWINGS

Reference will now be made in detail to embodiments, examples of which are illustrated in the accompanying drawings. In the drawings.

DETAILED DESCRIPTION OF THE DRAWINGS

In the following detailed description, numerous specific details are set forth in order to provide a thorough understanding of the subject matter herein. However, it will be apparent to one of ordinary skill in the art that the subject matter may be practiced without these specific details. In other instances, well known methods, procedures, techniques, components, and systems have not been described in detail so as not to unnecessarily obscure features of the embodiments. In the following description, it should be understood that features of one embodiment may be used in combination with features from another embodiment where the features of the different embodiment are not incompatible. The ensuing description provides some embodiment(s), and is not intended to limit the scope, applicability or configuration. Various changes may be made in the function and arrangement of elements without departing from the scope of the disclosure.

Figure 1:
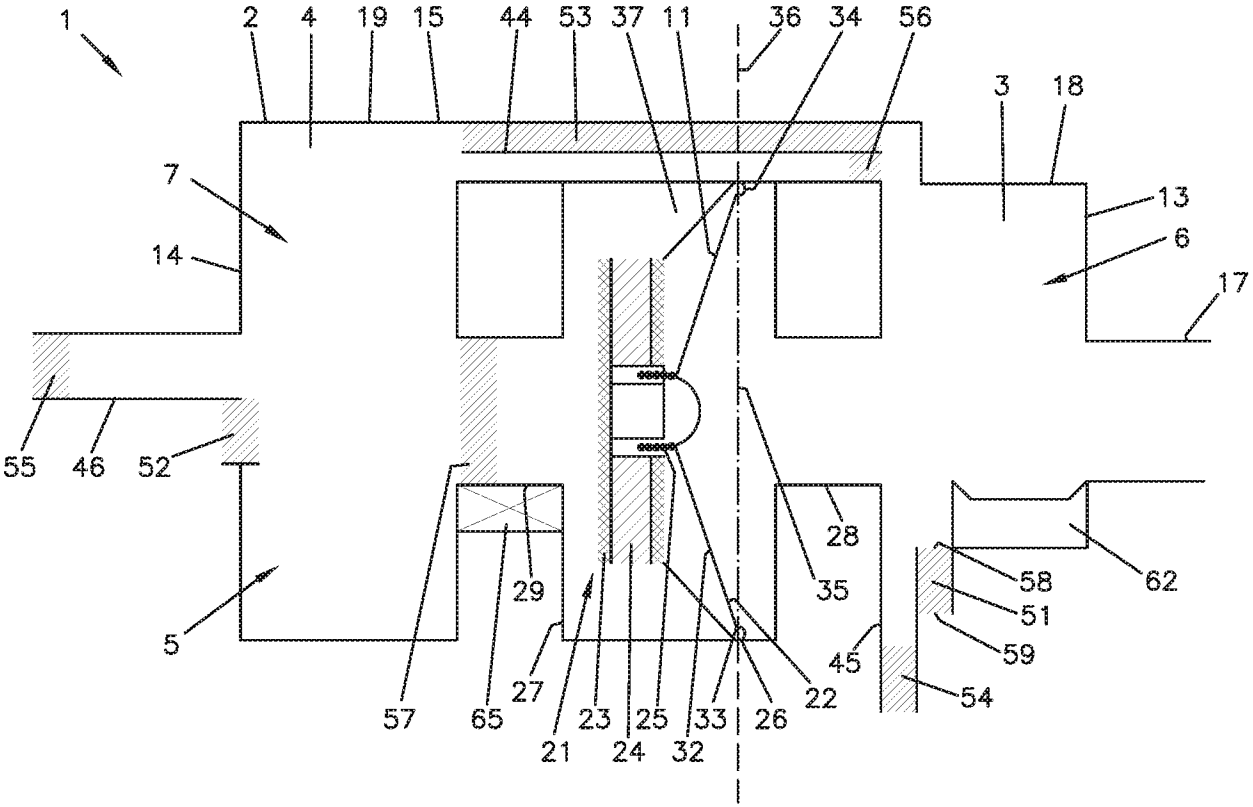
FIG. 1 schematically illustrates a hearing device comprising a housing accommodating an acoustic transducer, in accordance with some embodiments of the present disclosure.

FIG. 1 schematically illustrates a hearing device 1, in accordance with some embodiments of the present disclosure. Hearing device 1 comprises an acoustic transducer 21 and a transducer housing 27 accommodating acoustic transducer 21. Acoustic transducer 21 comprises an oscillator element 22 and an oscillation drive 23. Transducer housing 27 comprises a transducer front port 28 and a transducer rear port 29 opposing each other. Oscillator element 22 is arranged in a transducer chamber 37 enclosed by transducer housing 27. Oscillator element 22 is located between transducer front port 28 and transducer rear port 29 such that the sound waves emanated from oscillator element 22 can propagate through transducer front port 28 and transducer rear port 29. Acoustic transducer 21 is a driver. Oscillator element 22 is a membrane.

Oscillation drive 23 comprises a magnet 24 and a voice coil 25. A suspension member 26 mechanically couples oscillator element 22 to housing 2. Suspension member 26 connects oscillator element 22 with an inner surface of housing 2. Suspension member 26 forms a mechanical compliance having a value characteristic for a flexibility of the mechanical coupling. Voice coil 25 is mechanically connected to oscillator element 22, in particular by a rigid connection. Voice coil 25 is constrained to move axially through a cylindrical gap in magnet 24. A variable magnetic field can be created by providing a changing electric current through voice coil 25. The variable magnetic field can cause voice coil 25 to move back and forth inside the magnetic gap by a magnetic interaction between magnet 24 and voice coil 25. A corresponding movement of oscillator element 22 coupled to voice coil 25 can produce sound waves emanated from an oscillating area 32 of oscillator element 22.

Oscillator element 22 comprises a conical portion. Oscillating area 32 constitutes an inner surface of the conical portion. An outer edge 33 surrounds oscillating area 32. Outer edge 33 constitutes a part of an outer circumference of oscillator element 22 at a front end 34 of the conical portion. An active area 35 of acoustic transducer 21 is defined by a virtual plane laterally delimited by front end 34 of oscillator element 22. Active area 35 constitutes a part of an infinite virtual plane 36 intersecting outer edge 33 at front end 34 of oscillator element. Active area 35 forms a virtual base line of the conical portion. Front end 34 is located on the virtual base line. A boundary of active area 35 intersects outer edge 33 at front end 34 of oscillator element 22. Active area 35 faces in a direction in which oscillator element 22 is configured to oscillate, in particular a direction in which sound waves propagate during oscillation of oscillator element 22.

Hearing device 1 comprises a housing 2. Transducer housing 27 is integrated with housing 2. Housing 2 encloses a front chamber 3 acoustically coupled with transducer chamber 37 via transducer front port 28. Housing 2 encloses a rear chamber 4 acoustically coupled with transducer chamber 37 via transducer rear port 29. An inner volume 5 enclosed by housing 2 thus comprises front chamber 3, transducer chamber 37, and rear chamber 4. The sound waves produced by oscillator element 22 propagate inside inner volume 5. Inner volume 5 thus provides an acoustic pathway for the sound waves. A first volume portion 6 of inner volume 5 is located in front of oscillator element 22. First volume portion 6 thus comprises front chamber 3 and a portion of transducer chamber 37 in front of oscillator element 22. A second volume portion 7 of inner volume 5 is located behind oscillator element 22. Second volume portion 7 thus comprises rear chamber 4 and a portion of transducer chamber 37 behind oscillator element 22.

A virtual partition 11 separating first volume portion 6 and second volume portion 7 is defined by oscillator element 22 within an inner radial region of inner volume 5 in which oscillator element 22 extends, and by virtual plane 36 within an outer radial region of inner volume 5 ranging outside oscillator element 22. First volume portion 6 is located in front of virtual partition 11. Second volume portion 7 is located behind virtual partition 11. First volume portion 6 and second volume portion 7 are acoustically coupled by oscillator element 22. The acoustic pathway inside inner volume 5 thus extends between first volume portion 6 and second volume portion 7 through oscillator element 22. Sound waves can traverse virtual partition 11 through oscillator element 22. Oscillator element 22 is configured to transfer pressure variations caused by the sound waves between first volume portion 6 and second volume portion 7.

Housing 2 comprises a first housing portion 18 enclosing first volume portion 6. Housing 2 comprises a second housing portion 19 enclosing second volume portion 7. Housing 2 comprises a front wall 13, a rear wall 14 opposing front wall 13, and a side wall 15 connecting front wall 13 and rear wall 14. Front wall 13 is adapted to face an ear canal when housing 2 is inserted into the ear canal. First housing portion 18 comprises front wall 13 and a portion of side wall 15. Second housing portion 19 comprises rear wall 14 and a portion of side wall 15. Virtual plane 36 intersects side wall 15 between first housing portion 18 and second housing portion 19.

First housing portion 18 comprises a sound outlet 17. Sound outlet 17 leads from inner volume 5 to an exterior of housing 2 such that sound outlet 17 is configured to release sound waves from inner volume 5 to the exterior. Sound outlet 17 extends the acoustical pathway for the sound waves from inner volume 5 to the exterior of housing 2. Inner volume 5 is acoustically coupled to the exterior via sound outlet 17. Sound outlet 17 is arranged in front of oscillator element 22. Oscillator element 22 faces sound outlet 17. A middle axis extends longitudinally through a cross-sectional center of housing 2 through oscillator element 22 and sound outlet 17 along the acoustical pathway. Sound outlet 17 is fixed to front wall 13. Sound outlet 17 is a tubular member, in particular a spout, having an open rear end adjoining an aperture in front wall 13 and an open front end opposing the rear end. The open front end is free such that the sound waves can be released from housing 2 to the exterior through the open front end of sound outlet 17.

Sound outlet 17 can be at least partially inserted into an ear canal. After insertion, a portion of sound outlet 17 comprising the open front end is positioned in an inner region of an ear canal and a portion of housing 2 enclosing inner volume 5 is located outside the ear canal in an ambient environment. Sound outlet 17 is therefore configured to release sound waves into the ear canal. First housing portion 18 is further configured to contact an ear canal wall of the ear canal. In this way, first housing portion 18 can form an acoustical seal with the ear canal wall. The acoustical seal can acoustically isolate the open front end of sound outlet 17 in the ear canal from the ambient environment outside the ear canal, at least to some extent. In this way, ambient sound from the ambient environment outside the ear canal can be at least partially blocked from entering an inner region of the ear canal.

An inner acoustic port 44 is positioned between first volume portion 6 and second volume portion 7. Inner acoustic port 44 provides an acoustical coupling between first volume portion 6 and second volume portion 7, in addition to the acoustical coupling provided by oscillator element 22. The acoustic pathway between first volume portion 6 and second volume portion 7 thus extends through inner acoustic port 44. Inner acoustic port 44 provides a reactive element between first volume portion 6 and second volume portion 7. Inner acoustic port 44 extends through virtual partition 11. Inner acoustic port 44 is a tubular member connecting first volume portion 6 and second volume portion 7. Inner acoustic port 44 has an acoustic mass that can be modified by selecting a length and/or a cross sectional size of the tubular member. In this way, the output impedance of hearing device 1 can be influenced by selecting an appropriate acoustic mass of inner acoustic port 44.

A first outer acoustic port 45 is positioned between first volume portion 6 and the ambient environment outside housing 2. Outer acoustic port 45 is provided at first housing portion 18. Outer acoustic port 45 comprises a tubular member extending from side wall 15 into first volume portion 6. A second outer acoustic port 46 is positioned between second volume portion 7 and the ambient environment outside housing 2. Outer acoustic port 46 is provided at second housing portion 19. Outer acoustic port 46 comprises a tubular member extending from rear wall 14 into second volume portion 7. Outer acoustic ports 45, 46 each provide a reactive element extending the acoustic pathway from inner volume 5 to the ambient environment. An acoustic mass of outer acoustic ports 45, 46 can be set by selecting a length and/or a cross sectional size of the respective tubular member allowing to influence the output impedance of hearing device 1.

An acoustic resistance 51 comprises a first terminal 58 and a second terminal 59. Acoustic resistance 51 is configured to attenuate a sound pressure of sound waves propagating between first terminal 58 and second terminal 59. The attenuation of the sound waves can be provided by a sound resistive body between first terminal 58 and second terminal 59. The sound resistive body can comprise, for instance, a grid structure such as a wire mesh and/or a damping material such as a cloth. Acoustic resistance 51 provides a resistive element. Acoustic resistance 51 is positioned such that it provides an acoustical coupling between two volume portions, the first volume portion adjoining first terminal 58 and the second volume portion adjoining second terminal 59. Acoustic resistance 51 thus provides an acoustical coupling between the two volume portions. Acoustic resistance 55 can allow a damping of resonances over a defined frequency range, for instance a damping of high frequency and/or low frequency resonances. In this way, a frequency output of hearing device 51 can be reduced at a desired frequency range and/or increased at a desired frequency range relative to another frequency range. The frequency output can be defined by amplitudes of a frequency spectrum of sound waves released through sound outlet 17. The output impedance of hearing device 1 can thus be influenced, in particular for a selected frequency range.

The first terminal of acoustic resistance 51 is oriented towards first chamber 25. The second terminal of acoustic resistance 51 is oriented towards the ambient environment outside inner volume 5. Acoustic resistance 51 thus provides an acoustical coupling between two volume portions, namely first volume portion 6 and the ambient environment, corresponding to the volume portions acoustically coupled by outer acoustic port 45. Acoustic resistance 51 is placed in parallel to first outer acoustic port 45. Acoustic resistance 51 is provided separate from outer acoustic port 45. Acoustic resistance 51 is provided at first housing portion 18 at a distance to outer acoustic port 45. An acoustic resistance 52 is placed in parallel to second outer acoustic port 46. The first terminal of acoustic resistance 52 is oriented towards second volume portion 7. The second terminal of acoustic resistance 52 is oriented towards the ambient environment. Acoustic resistance 52 thus provides an acoustical coupling between the volume portions acoustically coupled by outer acoustic port 46. Acoustic resistance 52 is provided separate from outer acoustic port 46. Acoustic resistance 52 is provided at second housing portion 19 at a distance to outer acoustic port 46. An acoustic resistance 53 is placed in parallel to inner acoustic port 44. The first terminal of acoustic resistance 53 is oriented towards first volume portion 6. The second terminal of acoustic resistance 53 is oriented towards second volume portion 7. Acoustic resistance 53 thus provides an acoustical coupling between the volume portions acoustically coupled by inner acoustic port 44 and oscillator element 22. Acoustic resistance 53 is provided separate from oscillator element 22. Acoustic resistance 53 is provided separate from inner acoustic port 44. Acoustic resistance 52 is provided inside inner volume 5 at a distance to oscillator element 22 and inner acoustic port 44.

An acoustic resistance 54 is placed in series with first outer acoustic port 45. The first terminal of acoustic resistance 54 is oriented towards first volume portion 6. The second terminal of acoustic resistance 54 is oriented towards the ambient environment. Acoustic resistance 54 thus provides an acoustical coupling between the volume portions acoustically coupled by outer acoustic port 45. Acoustic resistance 54 is provided at outer acoustic port 45. An acoustic resistance 55 is placed in series with second outer acoustic port 46. The first terminal of acoustic resistance 55 is oriented towards second volume portion 7. The second terminal of acoustic resistance 55 is oriented towards the ambient environment. Acoustic resistance 55 thus provides an acoustical coupling between the volume portions acoustically coupled by outer acoustic port 46. Acoustic resistance 55 is provided at outer acoustic port 46. An acoustic resistance 56 is placed in series with inner acoustic port 44. The first terminal of acoustic resistance 56 is oriented towards first volume portion 6. The second terminal of acoustic resistance 56 is oriented towards second volume portion 7. Acoustic resistance 56 thus provides an acoustical coupling between the volume portions acoustically coupled by inner acoustic port 44. Acoustic resistance 56 is provided at inner acoustic port 44. An acoustic resistance 57 is placed in series with transducer rear port 229. The first terminal of acoustic resistance 56 is oriented towards transducer chamber 37. The second terminal of acoustic resistance 56 is oriented towards rear chamber 4. Acoustic resistance 57 thus provides an acoustical coupling between the volume portions acoustically coupled by transducer rear port 229. Acoustic resistance 56 is provided at transducer rear port 229. Acoustic resistances 51-57 can be selected to influence the output impedance of hearing device 1 in a desired way, in particular in a frequency dependent manner.

A microphone 62 is provided in first volume portion 6. Thus, microphone 6 is acoustically coupled to an ear canal, when housing 2 is at least partially inserted into the ear canal. In particular, microphone 6 can be located inside the ear canal and/or outside the ear canal when it is acoustically coupled to the ear canal via first volume portion 6. Microphone 62 is an ear canal microphone. Microphone 62 is provided in proximity to sound outlet 17. Microphone 62 is mounted on an inner surface of first housing portion 18. Hearing device 1 further comprises an active feedback control (AFC) circuit 65. AFC circuit 65 can be provided at housing 2, in particular inside inner volume 5 and/or outside inner volume 5. AFC circuit 65 can also be provided remote from housing 2. AFC circuit 65 is configured to provide an active feedback control signal to modify the sound waves generated by acoustic transducer 21. AFC circuit 65 is connected to microphone 62. Microphone 62 is configured to provide a feedback microphone signal to AFC circuit 65. Microphone 62 may thus also be referred to as a feedback microphone. An active feedback loop comprises microphone 62 and AFC circuit 65. The active feedback loop can modify the sound waves generated by acoustic transducer 21 depending on the feedback signal of microphone 62. The active feedback loop can be configured to provide an active noise control (ANC) or active noise reduction (ANR) of the sound waves output from the hearing device.

The general operating principle of such an active feedback loop is well known in the art. For instance, a circuit as described in U.S. Pat. Nos. 4,985,925, 8,682,001 B2, 9,792,893 B1, US 2018/0286373 A1 or US 2018/0197527 A1 can be applied. It has been found, however, that an application of the active feedback loop can result in an instable behavior of the sound output of the hearing device. The instabilities can be partially circumvented by a suitable signal processing performed by AFC circuit 65. But an effective suppression of the instable behavior based on the signal processing can depend on an actual size and geometry of the ear canal. While the instabilities may be decreased or avoided for some ear canals, they can still be present or even more pronounced in other ear canals.

Figure 2:
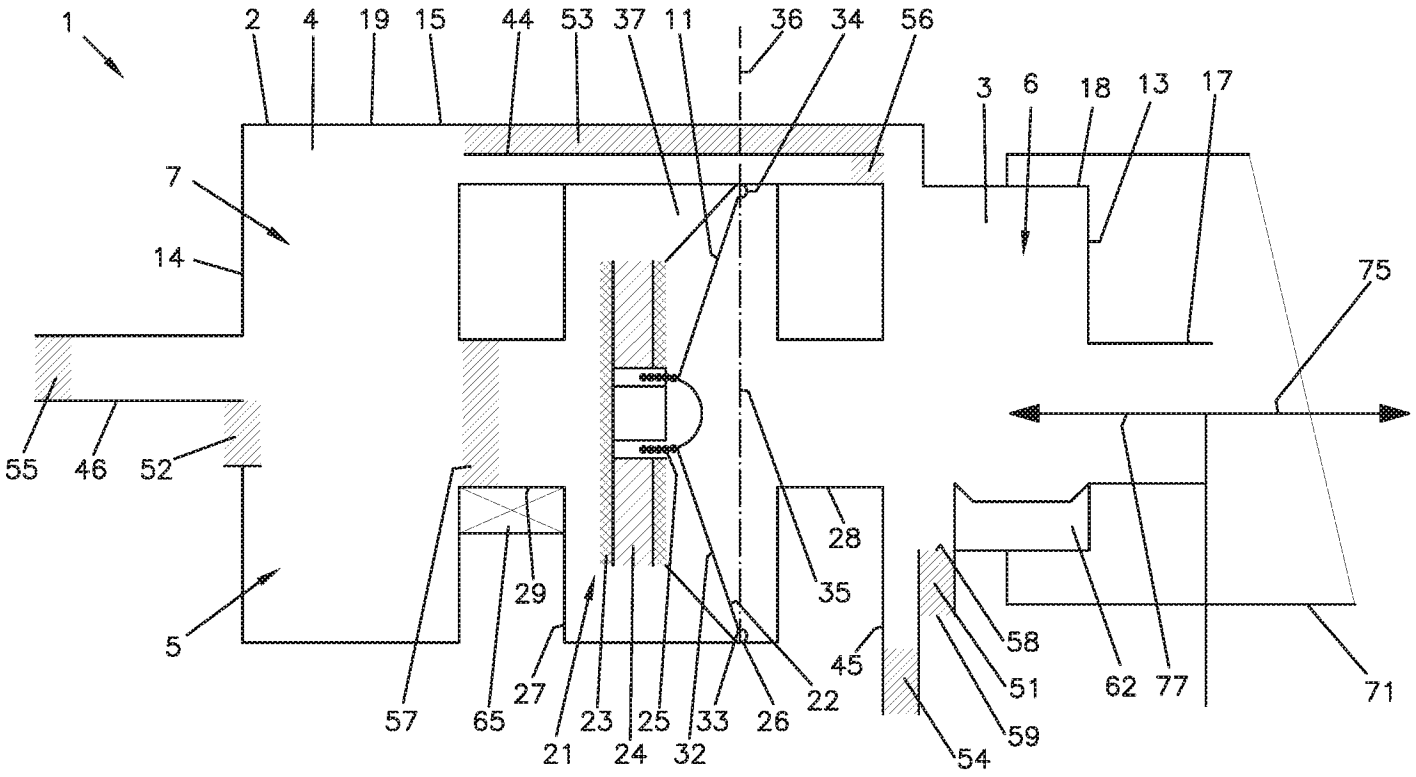
FIG. 2 schematically illustrates the hearing device shown in FIG. 1 partially inserted into an ear canal.

FIG. 2 schematically illustrates hearing device 1 partially inserted in an ear canal 71. Further symbolized by a respective arrow are an input impedance 75, or load impedance, and an output impedance 77 of hearing device 1. Output impedance 77 refers to an impedance value measured at sound outlet 17 in a calm environment, in particular when no sound waves are generated by acoustic transducer 21. Output impedance 77 can be a value measured at sound outlet 17 by feeding sound waves into inner volume 5 through sound outlet 17, in particular from the free end of sound outlet 17, and detecting the sound waves returning from inner volume 5 at sound outlet 17, in particular at the free end of sound outlet 17. Techniques for measuring input impedance 75 and output impedance 77 are described, for instance, in Leo L. Beranek, "Acoustical Measurements", published by the American Institute of Physics, 1988, and in Alfred Stirnemann, "Impedanzmessungen und Netzwerkmodell zur Ermittlung der Uebertragungseigenschaften des Mittelohrs", published by ETH Zurich, 1980.

In the context of the present disclosure, it has been found that acoustical instabilities provoked by the active feedback loop can be remedied by providing output impedance 77 with a value of at most $2\cdot10^{7}$ kg/(m$^{4}$·sec) at a frequency range between 1000 Hz and 1500 Hz. The acoustical instabilities can be further improved by providing output impedance 77 with a value of at most at most $10^{8}$ kg/(m$^{4}$·sec) at a frequency range of 100 Hz and below. A reduction of the feedback instabilities can thus be achieved for a large variety of sizes and geometries of ear canal 71. A rather ear canal independent behavior of hearing device 1 can thus be provided. An aspect of the present disclosure therefore aims to equip hearing device 1 in such a way that the desired behavior of output impedance 77 can be achieved. It has been found that at least one of the following technical features can be exploited to obtain the desired impedance behavior. A combination of a plurality of the following features can lead to a further improvement of the intended output impedance adjustment:

- providing first volume portion 6 at least two times smaller than second volume portion 7, in particular at a value of first volume portion 6 of at most $25\cdot10^{-8}$ m$^{3}$ and/or a value of second volume portion 7 of at least $50\cdot10^{-8}$ m$^{3}$;
- providing at least one of outer acoustic ports 45, 46, preferably at least rear acoustic port 46 and more preferred both outer acoustic ports 45, 46, in particular by providing a comparatively small acoustical mass of the respective acoustic port 45, 46;
- providing inner acoustic port 44, in particular by providing a comparatively small acoustical mass of the acoustic port 44;
- providing at least one of acoustic resistances 51, 52, 53 in parallel to a respective acoustic port 44, 45, 46, preferably at least acoustic resistance 52 at second housing portion 19 and/or acoustic resistance 53 inside inner volume 5;
- providing at least one of acoustic resistances 54, 55, 56 in series to a respective acoustic port 44, 45, 46, preferably at least acoustic resistance 55 at rear port 46 and/or acoustic resistance 56 at inner port 44;
- maximizing oscillating area 32 of oscillator element 22, preferably by providing a value of active area 35 of at least $5\cdot10^{-5}$ m$^{2}$;
- minimizing a mass of oscillator element 22, preferably by providing oscillator element 22 with a value of its mass of at most $30\cdot10^{-6}$ kg;
- minimizing a mechanical compliance of suspension member 26, preferably by providing a value of the mechanical compliance of at least $12\cdot10^{-3}$ sec$^{2}$/kg; and
- minimizing an acoustical mass of sound outlet 17.

The provision of output impedance 77 in the above described way can account for a desired value of a microphone position acoustic impedance measured at an input of microphone 62. In particular, the microphone position acoustic impedance can be selected such that it has a value of at most $1\cdot10^{7}$ kg/(m$^{4}$·sec) at a frequency range between 1000 Hz and 1500 Hz and/or a value of at most $5\cdot10^{7}$ kg/(m$^{4}$·sec) at a frequency range of 100 Hz and below. Such an acoustic impedance value at the position of the input of microphone 62 can allow to reduce and/or avoid instabilities of the feedback loop by rendering the acoustic impedance at the feedback origin, at which the microphone input is located, substantially independent from variations of input impedances caused by different ear canal geometries. In particular, a ratio of the microphone position acoustic impedance and the input impedance can thus be substantially kept constant for different ear canals.

Figure 3:
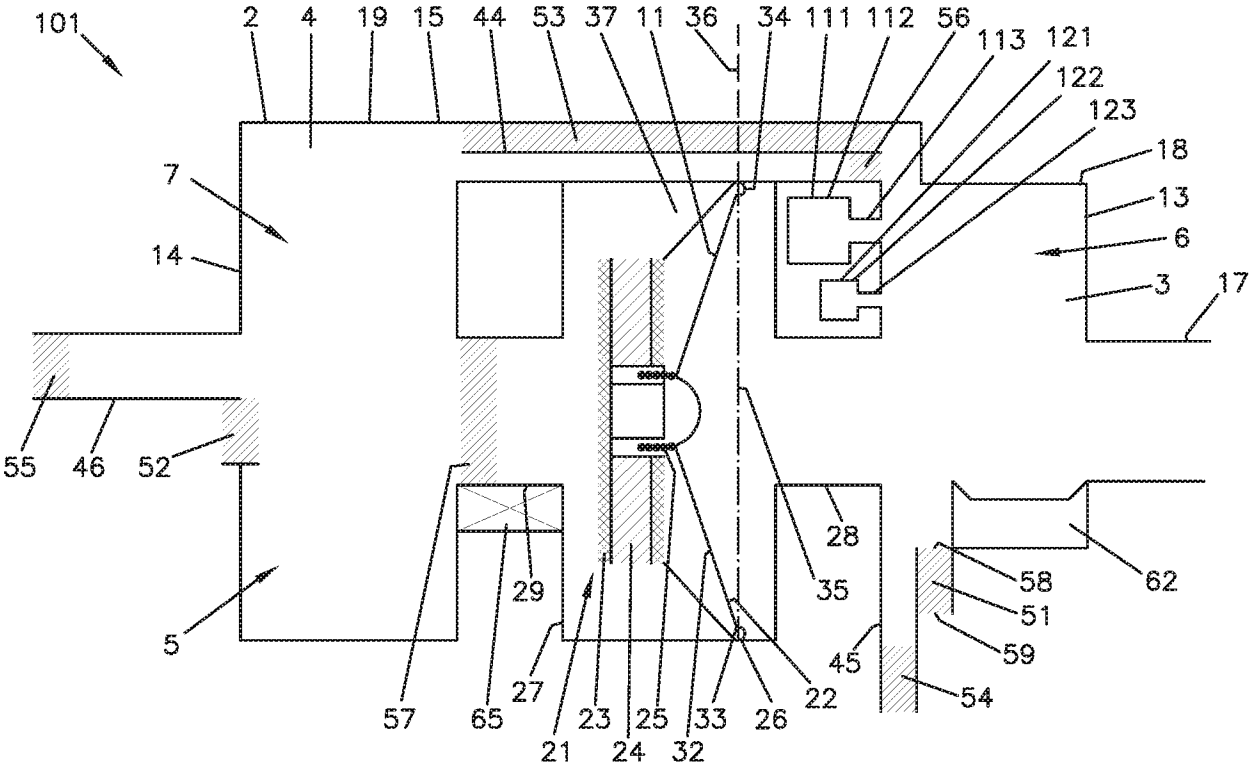
FIG. 3 schematically illustrates a hearing device comprising a housing accommodating an acoustic transducer, wherein an inner volume of the housing is acoustically coupled with a plurality of resonant members, in accordance with some embodiments of the present disclosure.

FIG. 3 schematically illustrates a hearing device 101, in accordance with some embodiments of the present disclosure. Corresponding features with respect to previously described embodiments of hearing device 1 are illustrated by the same reference numerals. Hearing device 101 comprises a plurality of resonant members 111, 121. Resonant members 111, 121 are acoustically coupled with first volume portion 6. By acoustically coupling resonant members 111, 121 with inner volume 5, acoustic properties of the acoustic pathway inside inner volume 5 can be modified in a frequency dependent manner. In particular, the output impedance of hearing device 101 can thus be adjusted. The acoustical coupling of resonant members 111, 121 to first volume portion 6 can allow a particular effective lowering of the output impedance of hearing device 101 at the respective frequency range. Resonant members 111, 121 are Helmholtz resonators.

Resonant members 111, 121 each enclose a cavity 112, 122 and an opening 113, 123 leading to cavity 112, 122. Resonant members 111, 121 can each comprise a vessel enclosing cavity 112, 122. Opening 113, 123 can be formed in the vessel. Opening 113, 123 is smaller as compared to a cross sectional size of cavity 112, 122. The acoustical coupling of resonant members 111, 121 with first volume portion 6 is provided via opening 113, 123. In particular, opening 113, 123 can be provided inside first volume portion 6 and/or adjoin first volume portion 6. Opening 113, 123 can be formed through a tubular member leading from cavity 112, 122, in particular from the vessel enclosing cavity 112, 122, to first volume portion 6. Cavity 112, 122 is filled with a medium adapted to resonate with sound waves. The medium is also provided at opening 113, 123. Part of the medium at opening 113, 123 forms an inertance and the remaining medium inside cavity 112, 122 forms a compliance. The medium inside resonant member 111, 112 is thus configured to vibrate at a resonance frequency when sound waves impinge on opening 113, 123. The resonance frequency depends on the size and shape of cavity 112, 122 and opening 113, 123, and the medium inside.

Resonant members 111, 121 are provided in front of oscillator element 22, in particular in front of virtual partition 11 comprising oscillator element 22. Resonant members 111, 121 are enclosed by first housing portion 18. Resonant members 111, 121 are arranged between transducer chamber 37 and front chamber 3. At least part of resonant members 111, 121 are configured to resonate with sound waves at a resonance frequency comprised in a frequency range between 1000 Hz and 1500 Hz. Alternatively or additionally, at least part of resonant members 111, 121 are configured to resonate with sound waves at a resonance frequency comprised in a frequency range between 1000 Hz and 1500 Hz. In this way, the output impedance of hearing device 101 can be lowered at the respective frequency range. At least two of resonant members 111, 121 are configured to resonate with sound waves at a different resonance frequency. For instance, a different size and/or shape of cavity 112, 122 and/or opening 113, 123 and/or a different medium inside at least two of resonant members 111, 121 can be provided. Thus, the frequency dependent adjustment of the acoustic properties of the acoustic pathway inside inner volume 5 can be further refined and/or extended over a larger frequency range. The resonant members comprise a first resonant member 111 and a second resonant member 121.

Figure 4:
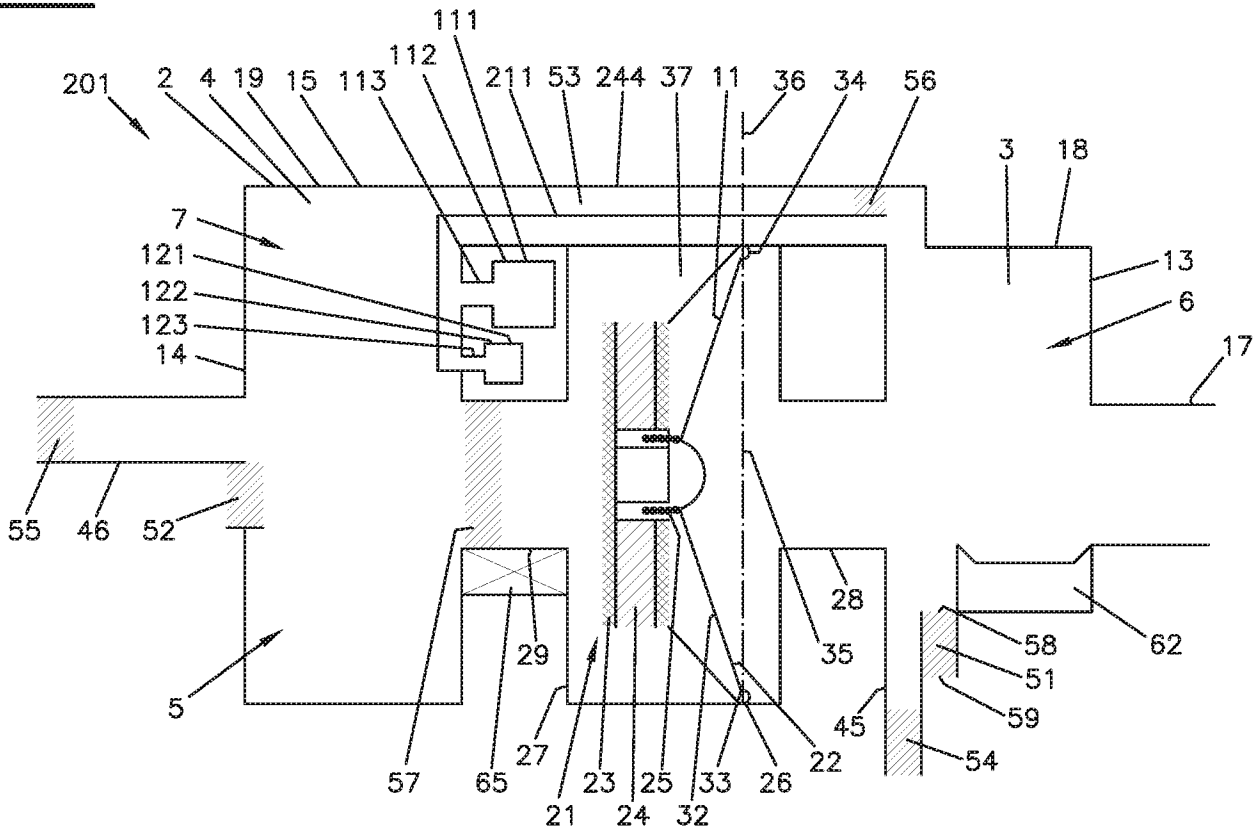
FIG. 4 schematically illustrates a hearing device comprising a housing accommodating an acoustic transducer, wherein an inner volume of the housing is acoustically coupled with a plurality of resonant members, in accordance with some embodiments of the present disclosure.

FIG. 4 schematically illustrates a hearing device 201, in accordance with some embodiments of the present disclosure. Corresponding features with respect to previously described embodiments of hearing devices 1 and 101 are illustrated by the same reference numerals. Resonant members 111, 121 are provided behind oscillator element 22, in particular behind virtual partition 11 comprising oscillator element 22. Resonant members 111, 121 are enclosed by second housing portion 19. Resonant members 111, 121 are arranged between transducer chamber 37 and rear chamber 4. By providing resonant members 111, 121 behind virtual partition 11, space can be saved in front of virtual partition 11. This can allow to provide first housing portion 18 at a rather compact size, in particular such that first housing portion 18 can optimized regarding an ear canal geometry and/or desired acoustical properties of first volume portion 6.

An acoustic port 211 acoustically couples resonant members 111, 121 with first volume portion 6. Acoustic port 211 is an inner acoustic port extending between first volume portion 6 and second volume portion 7. Acoustic port 211 traverses virtual partition 11. Acoustic port 211 is connected to resonant members 111, 121 at their opening 113, 123. Acoustic port 211 is closed inside second volume portion 7, in particular such that a portion of acoustic port 211 located inside second volume portion 7 is isolated from a remaining portion of second volume portion 7 except for the connection to resonant members 111, 121. Acoustic port 211 comprises an opening leading to first volume portion 6. Acoustic port 211 comprises a tubular member. An acoustic mass of acoustic port 211 can thus be modified by selecting a length and/or a cross sectional size of the tubular member. Another inner acoustic port 244 acoustically couples first volume portion 6 with second volume portion 7. Inner acoustic port 244 substantially corresponds to inner acoustic port 44 described above in the context of hearing devices 1, 101. Inner acoustic port 244 extends in parallel to acoustic port 211.

The invention claimed is:

1. A hearing device comprising:

a housing configured to be partially inserted into an ear canal;

an acoustic transducer having an oscillator element configured to generate sound waves, the housing accommodating the acoustic transducer inside an inner volume of the housing;

a suspension member configured to support the oscillator element inside the housing, wherein the suspension member has a mechanical compliance of at least $12 \cdot 10^{-3}$ $sec^2/kg$;

a sound outlet provided at the housing and configured to enable propagation of sound waves from the inner volume into the ear canal;

a microphone configured to be acoustically coupled to the ear canal; and an active feedback control circuit electronically connected to the microphone and configured to provide an active feedback control signal to modify the sound waves generated by the acoustic transducer, wherein the active feedback control circuit is configured to provide an active noise control (ANC) or active noise reduction (ANR) of the sound waves generated by the acoustic transducer, and wherein the acoustic transducer and the housing are configured such that an output impedance of the hearing device measured at the sound outlet has a value of at most $3.5 \cdot 10^7$ $kg/(m^4 \cdot sec)$ within a frequency bandwidth of at least 50 Hz comprised in a frequency range between 1000 Hz and 2000 Hz.

2. The hearing device according to claim 1, wherein the housing further comprises a first housing portion enclosing a first volume portion of the inner volume in front of the oscillator element and a second housing portion enclosing a second volume portion of the inner volume behind the oscillator element, the first volume portion and the second volume portion acoustically coupled by the oscillator element.

3. The hearing device according to claim 2, wherein the oscillator element is positioned inside the inner volume such that the first volume portion is at least two times smaller than the second volume portion.

4. The hearing device according to claim 3, wherein the first volume portion has a value of at most $25 \cdot 10^{-8}$ $m^3$.

5. The hearing device according to claim 4, the hearing device further comprising: an inner acoustic port acoustically coupling the first volume portion and the second volume portion, the inner acoustic port physically separated from the oscillator element.

6. The hearing device according to claim 2, characterized by an outer acoustic port acoustically coupling the inner volume with an ambient environment outside the inner volume.

7. The hearing device according to claim 6, wherein the outer acoustic port is a first outer acoustic port acoustically coupling the first volume portion with the ambient environment, wherein the hearing device further comprises a second outer acoustic port acoustically coupling the second volume portion with the ambient environment.

8. The hearing device according to claim 1, wherein the hearing device further comprises a resonant member configured to resonate with sound waves at a resonance frequency, wherein the resonant member is acoustically coupled with said inner volume.

9. The hearing device according to claim 8, wherein:

the housing further comprises a first housing portion enclosing a first volume portion of the inner volume in front of the oscillator element and a second housing portion enclosing a second volume portion of the inner volume behind the oscillator element; and the resonant member is acoustically coupled with the first volume portion.

10. The hearing device according to claim 9, wherein the resonance frequency is comprised in a frequency range between 800 Hz and 4000 Hz.

11. The hearing device according to claim 10, wherein the resonant member is a first resonant member, wherein the hearing device further comprises a second resonant member configured to resonate with sound waves at a different resonance frequency than the first resonant member is acoustically coupled with the inner volume.

12. The hearing device according to claim 11, wherein the first resonant member is provided in front of the oscillator element.

13. The hearing device according to claim 12, wherein the first resonant member is provided behind the oscillator element.

14. The hearing device according to claim 13, wherein an active area of the acoustic transducer has a value of at least $5 \cdot 10^{-5}$ $m^2$, the active area defined as a virtual plane delimited by a front end of the oscillator element.

15. The hearing device according to claim 1, wherein the oscillator element has mass of at most $30 \cdot 10^{-3}$ g.

16. The hearing device according to claim 1, wherein the output impedance is measurable at the sound outlet by producing an acoustic flow through the sound outlet into the inner volume and detecting an acoustic pressure at the sound outlet.

17. A hearing device comprising:

a housing configured to be partially inserted into an ear canal;

an acoustic transducer having an oscillator element configured to generate sound waves, the housing accommodating the acoustic transducer inside an inner volume of the housing;

a sound outlet provided at the housing and configured to enable propagation of sound waves from the inner volume into the ear canal;

a resonant member configured to resonate with sound waves at a resonance frequency in a frequency range between 800 Hz and 4000 Hz, wherein the resonant member is acoustically coupled with said inner volume;

a microphone configured to be acoustically coupled to the ear canal; and an active feedback control circuit electronically connected to the microphone and configured to provide an active feedback control signal to modify the sound waves generated by the acoustic transducer, wherein the active feedback control circuit is configured to provide an active noise control (ANC) or active noise reduction (ANR) of the sound waves generated by the acoustic transducer, and wherein the acoustic transducer and the housing are configured such that an output impedance of the hearing device measured at the sound outlet has a value of at most $3.5 \cdot 10^7$ $kg/(m^4 \cdot sec)$ within a frequency bandwidth of at least 50 Hz comprised in a frequency range between 1000 Hz and 2000 Hz.

* * * * *